US012467728B2

(12) United States Patent
Muster et al.

(10) Patent No.: US 12,467,728 B2
(45) Date of Patent: Nov. 11, 2025

(54) DEFORMATION BULLET FOR POLICE AND AUTHORITY AMMUNITION

(71) Applicant: RUAG Ammotec AG, Thun (CH)

(72) Inventors: Michael Muster, Munich (DE); Donald Meyer, Grolley (CH); Paul Howald, Unterlangenegg (CH); Markus Grünig, Längenbühl (CH)

(73) Assignee: RUAG AMMOTEC AG, Thun (CH)

( * ) Notice: Subject to any disclaimer, the term of this patent is extended or adjusted under 35 U.S.C. 154(b) by 0 days.

(21) Appl. No.: 18/547,823

(22) PCT Filed: Feb. 25, 2022

(86) PCT No.: PCT/EP2022/054874
§ 371 (c)(1),
(2) Date: Aug. 24, 2023

(87) PCT Pub. No.: WO2022/180245
PCT Pub. Date: Sep. 1, 2022

(65) Prior Publication Data

US 2024/0142206 A1 May 2, 2024

(30) Foreign Application Priority Data

Feb. 26, 2021 (DE) ..... 10 2021 104 760.9

(51) Int. Cl.
*F42B 12/74* (2006.01)
*F42B 12/34* (2006.01)

(52) U.S. Cl.
CPC ..... *F42B 12/74* (2013.01); *F42B 12/34* (2013.01)

(58) Field of Classification Search
CPC ..... F42B 12/34
USPC ..... 102/507–510
See application file for complete search history.

(56) References Cited

U.S. PATENT DOCUMENTS

| | | | | |
|---|---|---|---|---|
| 219,840 | A * | 9/1879 | Winchester | F42B 12/74 102/509 |
| 4,175,492 | A * | 11/1979 | Knappworst | F42B 12/34 102/517 |
| 5,127,332 | A | 7/1992 | Corzine et al. | |
| 6,845,717 | B1 | 1/2005 | Sauvestre | |
| 9,121,677 | B2 * | 9/2015 | Emary | F42B 14/02 |
| 10,260,850 | B2 * | 4/2019 | Morse | F42B 7/08 |
| 10,663,271 | B2 * | 5/2020 | Rogers | F42B 33/00 |
| 2004/0003747 | A1 * | 1/2004 | Hietanen | F42B 12/34 102/510 |

(Continued)

FOREIGN PATENT DOCUMENTS

| | | | |
|---|---|---|---|
| DE | 60010884 | T2 | 5/2005 |
| DE | 102011005389 | B3 | 3/2012 |

(Continued)

OTHER PUBLICATIONS

English Translation.*

(Continued)

*Primary Examiner* — Reginald S Tillman, Jr.
(74) *Attorney, Agent, or Firm* — FITCH, EVEN, TABIN & FLANNERY, LLP

(57) ABSTRACT

The present invention relates to a hollow-point bullet, for example for police and/or authority ammunition with a caliber of at most 13 millimeters, which is made of iron, in particular soft iron.

26 Claims, 3 Drawing Sheets

(56) References Cited

U.S. PATENT DOCUMENTS

Figure 1:
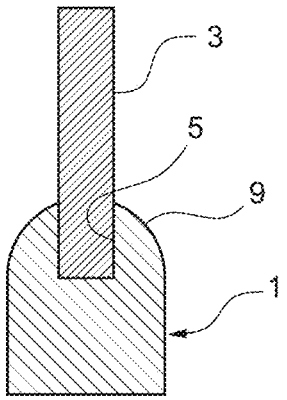

| | | | | |
|---|---|---|---|---|
| 2008/0216700 | A1* | 9/2008 | Martini Filho | F42B 12/74 102/509 |
| 2009/0301338 | A1 | 12/2009 | Schmitz et al. | |
| 2018/0106581 | A1 | 4/2018 | Rogers | |
| 2019/0003809 | A1 | 1/2019 | Smith | |

FOREIGN PATENT DOCUMENTS

| | | | | |
|---|---|---|---|---|
| DE | 102017011359 | A1 | 6/2019 | |
| DE | 102019135875 | A1 | 7/2021 | |
| EP | 2498045 | A1 * | 9/2012 | F42B 12/34 |
| EP | 0636853 | A1 | 2/2017 | |
| WO | 94/00730 | A1 | 1/1994 | |

OTHER PUBLICATIONS

Examination Report dated Oct. 8, 2021 in DE App. No. 10 2021 104 760.9.

English translation of International Search Report and Written Opinion dated Jun. 7, 2022 in Appl. No. PCT/ EP2022/054874.

Saarstahl. 'Produktkat Alog' Volklingen, XP055923934, Apr. 16, 2018 (Apr. 16, 2018), URL:https : / /www.saarstahl.com/sag/ downloads/ download/1224 (cited in the International Search Report dated Jun. 7, 2022 in Appl. No. PCT/EP2022/054874).

International Search Report dated Jun. 7, 2022 in PCT/EP2022/ 054874.

* cited by examiner

DEFORMATION BULLET FOR POLICE AND AUTHORITY AMMUNITION

CROSS-REFERENCE TO RELATED APPLICATIONS

This application is a U.S. national phase application filed under 35 U.S.C. § 371 of International Application No. PCT/EP2022/054874, filed Feb. 25, 2022, designating the United States, which claims priority from German Application No. 10 2021 104 760.9, filed Feb. 26, 2021, which are incorporated herein by reference in their entireties.

The present invention relates to deformation bullets and, in particular, hollow-point bullets, for example, for police and/or authority ammunition with a caliber of at most 13 mm. Furthermore, the present invention relates to police and/or authority ammunition with a caliber of at most 13 mm. Police and/or authority ammunition is characterized, inter alia, by the fact that the firing range is generally less than 150 m. Deformation bullets of this type are characterized by a defined wound-ballistic behavior, namely a predetermined deformation, in particular mushrooming, after impact on the target.

For environmental and health reasons, in particular on practice shooting ranges, the use of lead as a material for bullets is becoming increasingly unsuitable. In the choice of materials for bullets, there is thus a conflict of interest, in particular between good precision as well as flight range and environmental compatibility. Alternative materials to lead, such as tin, zinc and copper, have proved to be less suitable because of their low density, which would ensure better environmental compatibility, but could entail significant losses in terms of precision and flight range. Furthermore, alternative solutions using brass projectiles also have decisive disadvantages in terms of barrel life and resistance to pressure through the gun barrel. The pressure is too high during powder burn-off, while the resulting muzzle velocity is too low. Another disadvantage is that a major component of brass is copper. Copper itself is also hazardous to health or bactericidal. The use of copper is therefore undesirable in terms of future environmental requirements.

In the prior art, hollow-point bullets are known in which an axially projecting ballistic insert, for example in the form of a sphere, is introduced into the nose-side central cavity. Such a bullet is known, for example, from EP 0636853 A1. The bullet according to EP 0636853 A1 is made of brass, which has the advantage of good deformation properties and easy machining. The central blind bore is produced by machining and a plastic ball is pressed into it, which causes the ball to be pushed axially inwards into the blind bore when the bullet hits the target, thereby widening the surrounding wall of the bullet body outwards. To secure the plastic bullet axially within the blind bore, the jacket surrounding the plastic ball is compressed or squeezed around it in a form-complementary manner, so that the plastic ball is held in a force-fit and form-fit manner. The bullet according to EP 0636853 A1 has proved to be disadvantageous above all due to the complex manufacturing process, namely the machining of the central blind bore and the connection between the plastic ball and the bullet body. In addition, the material brass is subject to the disadvantages described above. In particular, brass has been found to be disadvantageous in that the bullets are produced by machining, so that a large amount of waste is produced, which affects the cost. Furthermore, it has been found that the plastic ball on the nose-side to support the desired deformation may have a detrimental effect on the accuracy of the bullet.

A hollow-point bullet without a nose-side insert is known, for example, from US 2008/0216700 A1. The hollow-point bullet is designed without lead and is made of copper or a copper alloy, for example, which is why its precision is not satisfactory. It has also been found that the bullet according to US 2008/0216700 A1 does not always mushroom as desired.

It is the object of the present invention to improve the disadvantages of the known prior art, in particular to produce a deformation bullet with improved precision and/or environmental compatibility, the production of which is simplified and/or less expensive, in particular without impairing the mushrooming behavior.

This object is solved by the features of the independent claims.

According to this, a hollow-point bullet is provided for ammunition, for example for police and/or authority ammunition, in particular with a caliber of at most 13 mm. Type defining for hollow-point bullets is the hollow or cavity at the front-side in the region of the bullet tip. Bullets according to the invention can also be referred to as solid bullets, since they are formed in one piece, in particular from a homogeneous material. The hollow-point bullet is intended for use in handguns, i.e. revolvers, machine guns and/or pistols. A metallic hollow-point bullet may also be provided for rifles. Preferably, the hollow-point bullet is provided up to a caliber of 20 mm, in particular up to a caliber of 12 mm. Cartridges are comprised in a usual manner of a bullet, a cartridge case, propellant powder and a primer. The bullet is the object fired from the gun. With a cartridge caliber of 9 mm×19 (Luger or Para caliber), the weight of a bullet can be between 3 g and 20 g, in particular between 5 g and 15 g, preferably between 5.5 g and 9 g, in particular preferably between 6.0 g and 6.3 g, for example 6.1 g, for which use the penetration of a protective vest is to be excluded. Due to their weight and shape, the bullets of standard 9 mm Luger caliber cartridges reach muzzle velocities of 340 m/s. or more. The material of the hollow-point bullet is preferably lead-free and/or lead alloy-free. Caliber is generally referred to as a measure of the outside diameter of projectiles or bullets and the inside diameter of a firearm barrel. For example, hollow-point bullets according to the invention are also used for ammunition with a caliber of less than 9 mm, less than 7 mm or at most 5.6 mm. In contrast to full metal jacket bullets, which are generally comprised of a bullet jacket made of a deformable material, such as tombac, and a bullet core arranged therein, usually pressed, which is produced separately from the bullet jacket, hollow-point bullets often do not have a separate jacket. In particular, the hollow-point bullet is made in one piece.

The bullet may have a, in particular an ogive-shaped, bullet nose with a central cavity, and a bullet tail. The bullet tail can be made substantially of solid material and/or be fully cylindrical at least sectionally. The maximum outer diameter defining the caliber of the bullet may be present in the region of the bullet tail. When in the present description reference is made to nose, front, nose-side or front-side, or tail, tail-side or rear-side, this is to be understood with reference to a longitudinal axis of the bullet pointing in the direction of bullet flight. The bullet tail can, for example, have the guiding band, which is, in particular at least sectionally, cylindrical, for guiding the deformation bullet in the firearm barrel. The guide band may, for example, be configured to engage a land-and-groove profile of the firearm barrel, which serves in particular to impart a twist to the deformation bullet as it slides along within the firearm barrel in order to stabilize the bullet trajectory. The bullet nose can have a nose wall delimiting the cavity, which has an ogive-shaped contour on its outer side at least sectionally.

A phase section may be located at the tail-side end of the bullet tail to facilitate insertion of the hollow-point bullet into a neck of a cartridge case and/or to form a particularly aerodynamic tail end (commonly referred to as a "boat-tail").

The bullet nose, particularly the ogive section thereof, may have an ogive wall and a rotationally symmetric ogive cavity circumferentially delimited by the ogive wall. The ogive cavity allows the bullet to undergo deformation in the form of compression upon impact with a target or other resistance. Upon compression of the bullet according to the invention, its kinetic energy is rapidly converted into deformation energy. When the bullet is compressed, the tip of the bullet preferably deforms relative to the, in particular cylindrical, tail section, substantially only in the axial and radial directions. For example, the deformation can be rotationally symmetrical.

The ogive cavity is preferably empty, i.e. filled only with ambient air. An inner contour encompassing the ogive cavity, which is defined by the ogive wall, is preferably formed without steps and/or interruptions in the circumferential direction and/or has exclusively rounded edges. An ogive outer surface defined by the ogive wall is preferably formed without steps in the circumferential direction and/or has a constant wall thickness circumferentially, in particular fully circumferentially.

According to one aspect of the present invention, the hollow-point bullet is made of iron, in particular soft iron. By means of the hollow-point bullet according to the invention, an environmentally compatible hollow-point bullet is created which exhibits improved ballistics. Furthermore, iron is inexpensive and is characterized by good formability, which simplifies the production of hollow-point bullets. It has been found that the hollow-point bullets made of iron according to the invention are particularly well suited for production by solid forming, in particular by cold forming, such as deep drawing or extrusion, as an alternative to machining. Iron also has the advantage that it can be after-treated, in particular thermally after-treated, such as soft annealed, better than the bullet materials used to date.

According to an exemplary embodiment, the hollow-point bullet is made of steel. The carbon content can be more than 0.05%. It has been found that increasing the carbon content increases the hardness and tensile strength of the hollow-point bullet and/or improves its formability, in particular optimizes it, which has a beneficial effect on bullet ballistics. Furthermore, the carbon content according to the invention has been found to have a corrosion-protective effect on the hollow-point bullet. Furthermore, the increased carbon content also helps to delimit diffusion between the firearm barrel and the hollow-point bullet when the latter is terminated by means of a firearm. For example, the carbon content may be in the range of 0.06% to 1.14%, particularly in the range of 0.08% to 0.12%. Such carbon ranges have been found to be particularly advantageous in terms of ballistics. In particular, it has been found that if the carbon content is too high, the brittleness of the hollow-point bullet body is increased too much, which has a detrimental effect on the production and formability of the hollow-point bullet.

In an exemplary embodiment, the hollow-point bullet according to the invention is made of a material which, in addition to iron, has at least one further transition metal, for example selected from the group comprising manganese and copper, in particular at a mass fraction from 0.01% to 1.2% or from 0.3% to 1%.

In another exemplary embodiment of the present invention, the material of the hollow-point bullet may include at least one other additive selected from the carbon group, the nitrogen group, and/or the oxygen group. By way of example, the at least one additive may be a semimetal. By way of example, the at least one additive may have a weight percentage of at least 0.01% to at most 0.48%.

In another exemplary embodiment, the iron of the hollow-point bullet has a manganese content of from 0.01% to 0.8%, particularly from 0.3% to 0.6%.

According to an exemplary further development, the iron has a silicon content of less than 3.5%, in particular less than 0.4% or less than 0.3%.

In another exemplary embodiment, the iron has a phosphorus content in the range from 0.01% to 0.04%, particularly in the range from 0.02% to 0.03%.

Furthermore, it may be provided that the iron has a sulfur content in the range from 0.01% to 0.04%, in particular in the range from 0.02% to 0.03%.

In another exemplary embodiment, the iron has a copper content of less than 0.4%, particularly less than 0.3% or less than 0.25%.

For example, the hollow-point bullet may be made of a Saar steel C10C.

In an exemplary further development of the hollow-point bullet according to the invention, the hollow-point bullet does not contain lead.

According to a further aspect of the present invention, which can be combined with the preceding aspects and exemplary embodiments, a deformation bullet, in particular a hollow-point bullet, is provided, for example for police and/or authority ammunition, in particular with a caliber of at most 13 mm. The deformation bullet can be designed according to one of the previously described aspects or exemplary embodiments.

The deformation bullet comprises a, in particular an ogive-shaped, bullet nose with a central cavity, and a bullet tail. The bullet tail can be made substantially of solid material and/or be fully cylindrical at least sectionally. The maximum outer diameter defining the caliber of the bullet may be present in the region of the bullet tail. When in the present description reference is made to nose, front, nose-side or front-side, or tail, tail-side or rear-side, this is to be understood with reference to a longitudinal axis of the bullet pointing in the direction of bullet flight. The bullet tail can, for example, have the guiding band, which is, in particular at least sectionally, cylindrical, for guiding the deformation bullet in the firearm barrel. The guide band may, for example, be configured to engage a land-and-groove profile of the firearm barrel, which serves in particular to impart a twist to the deformation bullet as it slides along within the firearm barrel in order to stabilize the bullet trajectory. The bullet nose can have a nose wall delimiting the cavity, which has an ogive-shaped contour on its outer side at least sectionally.

A phase section may be located at the tail-side end of the bullet tail to facilitate insertion of the hollow-point bullet into a neck of a cartridge case and/or to form a particularly aerodynamic tail end (commonly referred to as a "boat-tail").

The bullet nose, particularly the ogive section thereof, may have an ogive wall and a rotationally symmetric ogive cavity circumferentially delimited by the ogive wall. The ogive cavity allows the bullet to undergo deformation in the form of compression upon impact with a target or other resistance. Upon compression of the bullet according to the invention, its kinetic energy is rapidly converted into deformation energy. When the bullet is compressed, the tip of the bullet preferably deforms relative to the, in particular cylindrical, tail section, substantially only in the axial and radial directions.

The ogive cavity is preferably empty, i.e. filled only with ambient air. An inner contour encompassing the ogive cavity, which is defined by the ogive wall, is preferably formed without steps and/or interruptions in the circumferential direction and/or has exclusively rounded edges. An ogive outer surface defined by the ogive wall is preferably formed without steps in the circumferential direction and/or has a constant wall thickness circumferentially, in particular fully circumferentially.

For example, the deformation bullet may be produced without machining. The deformation bullet may further have an intermediate state of production, in which the bullet is present as an intermediate, in which the jacket wall forming the bullet nose on the finished bullet has a substantially constant rectilinear extension, in particular a constant inner and/or outer diameter.

According to further aspect of the present invention, the cavity extends from a front-side opening without forming an undercut in the direction of a tail-side cavity base. The cavity base may, for example, be concave in shape and/or have various radii of concavity. The undercut-free cavity has been shown to be advantageous, particularly with respect to mushrooming behavior in target ballistics. For example, the undercut may be, at least sectionally in the longitudinal direction of the bullet, frustoconical, cylindrical or part-circular. For example, the cavity can be produced by solid forming in a punch-die arrangement, wherein in particular the plunger, in particular its outer shape, is responsible for the cavity inner geometry.

In an exemplary embodiment, a nose wall delimiting the cavity has at least sectionally a substantially constant inner diameter. For example, the constant inner diameter may be formed over at least 30%, at least 40%, at least 50%, at least 60%, at least 70%, at least 80% or at least 90% of a total longitudinal extension of the cavity. For example, the constant inner diameter of the cavity is present up to the, in particular at least sectionally concave-shaped, cavity base.

The inventors of the present invention have found that the production step of bending the nose wall surrounding the cavity radially inward, which has been used until now, can be omitted without sacrificing precision and/or final ballistics.

According to a further aspect of the present invention, which can be combined with the preceding aspects and exemplary embodiments, a deformation bullet, in particular a hollow-point bullet, is provided, for example for police and/or authority ammunition, in particular with a caliber of at most 13 mm. The deformation bullet can be designed according to one of the previously described aspects or exemplary embodiments.

The deformation bullet comprises a, in particular an ogive-shaped, bullet nose with a central cavity, and a bullet tail. The bullet tail can be made substantially of solid material and/or be fully cylindrical at least sectionally. The maximum outer diameter defining the caliber of the bullet may be present in the region of the bullet tail. When in the present description reference is made to nose, front, nose-side or front-side, or tail, tail-side or rear-side, this is to be understood with reference to a longitudinal axis of the bullet pointing in the direction of bullet flight. The bullet tail can, for example, have the guiding band, which is, in particular at least sectionally, cylindrical, for guiding the deformation bullet in the firearm barrel. The guide band may, for example, be configured to engage a land-and-groove profile of the firearm barrel, which serves in particular to impart a twist to the deformation bullet as it slides along within the firearm barrel in order to stabilize the bullet trajectory. The bullet nose can have a nose wall delimiting the cavity, which has an ogive-shaped contour on its outer side at least sectionally.

A phase section may be located at the tail-side end of the bullet tail to facilitate insertion of the hollow-point bullet into a neck of a cartridge case and/or to form a particularly aerodynamic tail end (commonly referred to as a "boat-tail").

The bullet nose, particularly the ogive section thereof, may have an ogive wall and a rotationally symmetric ogive cavity circumferentially delimited by the ogive wall. The ogive cavity allows the bullet to undergo deformation in the form of compression upon impact with a target or other resistance. Upon compression of the bullet according to the invention, its kinetic energy is rapidly converted into deformation energy. When the bullet is compressed, the tip of the bullet preferably deforms relative to the, in particular cylindrical, tail section, substantially only in the axial and radial directions.

The ogive cavity is preferably empty, i.e. filled only with ambient air. An inner contour encompassing the ogive cavity, which is defined by the ogive wall, is preferably formed without steps and/or interruptions in the circumferential direction and/or has exclusively rounded edges. An ogive outer surface defined by the ogive wall is preferably formed without steps in the circumferential direction and/or has a constant wall thickness circumferentially, in particular fully circumferentially.

For example, the deformation bullet may be produced without machining. The deformation bullet may further have an intermediate state of production, in which the bullet is present as an intermediate, in which the jacket wall forming the bullet nose on the finished bullet has a substantially constant rectilinear extension, in particular a constant inner and/or outer diameter.

According to a further aspect of the present invention, the diameter of a front-side opening of the cavity is greater than 50% of the caliber of the bullet. This has two advantages in particular: firstly, the large cavity dimension in the radial direction reduces the wall thickness of the nose wall surrounding the cavity in the bullet nose. Secondly, when the bullet strikes a target, the large cavity dimension allows as much material of the target as possible to penetrate the cavity in order to cause the desired deformation, namely mushrooming radially outward, of the bullet. Both of these beneficial effects accelerate and enhance the desired mushrooming of the bullet. The faster the deformation takes place, the faster the diameter of the bullet increases and thus its resistance in the target. Penetration of a, for example, protective vest can be avoided more reliably.

In an exemplary embodiment, the opening diameter before impact of the bullet on a target is at least 55%, at least 60% or at least 65% of the caliber of the bullet. The larger the opening diameter is in relation to the caliber of the bullet, the more the above-mentioned technical effects or advantages are amplified.

According to a further aspect of the present invention, which can be combined with the preceding aspects and exemplary embodiments, a deformation bullet, in particular a hollow-point bullet, is provided, for example for police and/or authority ammunition, in particular with a caliber of at most 13 mm. The deformation bullet can be designed according to one of the previously described aspects or exemplary embodiments.

The deformation bullet comprises a, in particular an ogive-shaped bullet nose with a central cavity, and a bullet tail. The bullet tail can be made substantially of solid material and/or be fully cylindrical at least sectionally. The maximum outer diameter defining the caliber of the bullet may be present in the region of the bullet tail. When in the present description reference is made to nose, front, nose-side or front-side, or tail, tail-side or rear-side, this is to be understood with reference to a longitudinal axis of the bullet pointing in the direction of bullet flight. The bullet tail can, for example, have the guiding band, which is, in particular at least sectionally, cylindrical, for guiding the deformation bullet in the firearm barrel. The guide band may, for example, be configured to engage a land-and-groove profile of the firearm barrel, which serves in particular to impart a twist to the deformation bullet as it slides along within the firearm barrel in order to stabilize the bullet trajectory. The bullet nose can have a nose wall delimiting the cavity, which has an ogive-shaped contour on its outer side at least sectionally.

A phase section may be located at the tail-side end of the bullet tail to facilitate insertion of the hollow-point bullet into a neck of a cartridge case and/or to form a particularly aerodynamic tail end (commonly referred to as a "boat-tail").

The bullet nose, particularly the ogive section thereof, may have an ogive wall and a rotationally symmetric ogive cavity circumferentially delimited by the ogive wall. The ogive cavity allows the bullet to undergo deformation in the form of compression upon impact with a target or other resistance. Upon compression of the bullet according to the invention, its kinetic energy is rapidly converted into deformation energy. When the bullet is compressed, the tip of the bullet preferably deforms relative to the, in particular cylindrical, tail section, substantially only in the axial and radial directions.

The ogive cavity is preferably empty, i.e. filled only with ambient air. An inner contour encompassing the ogive cavity, which is defined by the ogive wall, is preferably formed without steps and/or interruptions in the circumferential direction and/or has exclusively rounded edges. An ogive outer surface defined by the ogive wall is preferably formed without steps in the circumferential direction and/or has a constant wall thickness circumferentially, in particular fully circumferentially.

For example, the deformation bullet may be produced without machining. The deformation bullet may further have an intermediate state of production, in which the bullet is present as an intermediate, in which the jacket wall forming the bullet nose on the finished bullet has a substantially constant rectilinear extension, in particular a constant inner and/or outer diameter.

According to another aspect of the present invention, a length of the cavity dimensioned in the longitudinal direction of the bullet is at most 50% of the bullet length. The inventors of the present invention have identified that because of the lower density of iron, particularly steel, compared to the materials previously used for bullets which included large proportions of lead, it is necessary to obtain solid material. Axially delimiting the cavity extension results in a larger solid portion of the bullet, i.e. made of solid material.

In an exemplary embodiment, the cavity length is at most 45%, in particular at most 40%, of the bullet length. The small cavity length also allows the bullet to be produced particularly inexpensively and simply, since large cavity depths, in particular pressing depths, can be omitted.

According to a further aspect of the present invention, which can be combined with the preceding aspects and exemplary embodiments, a deformation bullet, in particular a hollow-point bullet, is provided, for example for police and/or authority ammunition, in particular with a caliber of at most 13 mm. The deformation bullet can be designed according to one of the previously described aspects or exemplary embodiments.

The deformation bullet comprises a, in particular an ogive-shaped bullet nose with a central cavity, and can also have a bullet tail which can be made substantially of solid material and/or can be fully cylindrical at least sectionally. The maximum outer diameter defining the caliber of the bullet may be present in the region of the bullet tail. When in the present description reference is made to nose, front, nose-side or front-side, or tail, tail-side or rear-side, this is to be understood with reference to a longitudinal axis of the bullet pointing in the direction of bullet flight. The bullet tail can, for example, have the guiding band, which is, in particular at least sectionally, cylindrical, for guiding the deformation bullet in the firearm barrel. The guide band may, for example, be configured to engage a land-and-groove profile of the firearm barrel, which serves in particular to impart a twist to the deformation bullet as it slides along within the firearm barrel in order to stabilize the bullet trajectory. The bullet nose can have a nose wall delimiting the cavity, which has an ogive-shaped contour on its outer side at least sectionally.

A phase section may be located at the tail-side end of the bullet tail to facilitate insertion of the hollow-point bullet into a neck of a cartridge case and/or to form a particularly aerodynamic tail end (commonly referred to as a "boat-tail").

The bullet nose, particularly the ogive section thereof, may have an ogive wall and a rotationally symmetric ogive cavity circumferentially delimited by the ogive wall. The ogive cavity allows the bullet to undergo deformation in the form of compression upon impact with a target or other resistance. Upon compression of the bullet according to the invention, its kinetic energy is rapidly converted into deformation energy. When the bullet is compressed, the tip of the bullet preferably deforms relative to the, in particular cylindrical, tail section, substantially only in the axial and radial directions.

The ogive cavity is preferably empty, i.e. filled only with ambient air. An inner contour encompassing the ogive cavity, which is defined by the ogive wall, is preferably formed without steps and/or interruptions in the circumferential direction and/or has exclusively rounded edges. An ogive outer surface defined by the ogive wall is preferably formed without steps in the circumferential direction and/or has a constant wall thickness circumferentially, in particular fully circumferentially.

For example, the deformation bullet may be produced without machining. The deformation bullet may further have an intermediate state of production, in which the bullet is present as an intermediate, in which the jacket wall forming the bullet nose on the finished bullet has a substantially constant rectilinear extension, in particular a constant inner and/or outer diameter.

According to the further aspect of the invention, the wall thickness of a nose wall delimiting the cavity at the bullet tip is in the range from 0.1 mm to 2 mm, in particular in the range from 0.2 mm to 1.5 mm. For example, it may be provided that the wall thickness at the bullet tip must not be less than 0.5 mm. It has been recognized in the present case that the wall thickness at the bullet tip should be as thin as possible but as thick as necessary. The stressed areas represent the optimum in terms of manufacturability, target ballistics (deformation behavior) and stability of the bullet. The smaller the front-side wall thickness, in particular at the bullet tip, of the nose wall, the less deformation energy is required to achieve fast, in particular fast-reacting, and/or reliable mushrooming of the deformation bullet.

In an exemplary embodiment, the tip of the bullet is formed by a circumferential, in particular planar or tapered, ring, in particular with a planar ring surface, the wall thickness or radial dimension of which is less than 2 mm, in particular less than 1.5 mm, in particular less than 1 mm, less than 0.5 mm or even less than 0.2 mm.

In a further exemplary embodiment of the present invention, the cavity is open in the direction of the front, in particular it is not occupied by a filler component. The inventors of the present invention have found that the same deformation behavior can be achieved by means of the measures according to the invention, even if no filler or squeeze component is accommodated in the front-side, central cavity, which in the prior art had previously supported the deformation or radial mushrooming behavior of the bullet. This completely eliminates the step of axially inserting or pressing the filler component into the bullet wall. In this respect, costs can be saved. In addition, fewer components are required, which in turn results in cost savings.

In a further exemplary embodiment, an outer diameter of a nose wall delimiting the cavity circumferentially increases, in particular continuously, starting from the bullet tip in the direction of the bullet tail. For example, the outer diameter of the nose wall at the axial height of the cavity base, in particular of an axially deepest section of the cavity base, is smaller than the caliber of the bullet, which may be defined by the guide band, for example. In other words, the maximum outer diameter of the bullet, namely the caliber, starting from the tip of the bullet at the axial height of the cavity base has not yet been reached.

According to an exemplary further development, the central cavity has a cross-section which is point-symmetrical and deviates from a circular shape and is substantially constant in the longitudinal direction of the bullet. It has been found that the deformation behavior of the bullets according to the invention can be adjusted or determined via the cavity inner geometry. For example, the cavity may have a polygonal, torx-like or other point-symmetric shape. For example, the outer contour of the cavity cross-section may be formed by a sequence of protrusions and recesses, in particular by a tooth-hub structure. For example, the cavity is solidly formed using a punch, in particular a press plunger, whose outer geometry defines the inner geometry of the cavity. In other words, the inner cross-section of the cavity is pressed into the bullet.

In a further exemplary further development, a nose wall delimiting the cavity has on its outer side at least one weakening section oriented in the circumferential direction, in particular a completely circumferential weakening section. For example, at least 2, 3 or 4 weakening sections, in particular of identical design and/or manufacture, are provided at a particularly constant distance from one another on the outside of the nose wall and/or are introduced therein. The weakening section can be introduced, for example, by forming or machining. For example, the production of the weakening section is the only machining production step of the bullets. It has been found that the insertion of weakening sections can reliably achieve the desired deformation mushrooming effect. Furthermore, the extension of the weakening section in the axial and/or radial direction can be used to determine its influence on the deformation behavior and set it as desired. This means that the mushrooming behavior can be influenced or adjusted independently of the material and/or independently of after-treatment steps, for example thermal after-treatment steps.

In an exemplary further development, the weakening section forms a predetermined buckling point such that when the bullet impacts a target, the nose wall buckles radially outward at the predetermined buckling point. The radially outward buckling increases the diameter of the bullet and thus the energy output per centimeter of wound ballistics. Compared with the rest of the nose wall, the predetermined buckling point is particularly fast-reacting, i.e. responds quickly, to acting deformation energy resulting from the impact of the bullet on a target. This accelerates the increase in diameter of the bullet and thus the mushrooming behavior.

In a further exemplary further development, the weakening section is realised as a notch. For example, a notch depth is at most 60% of a wall thickness of the nose wall, in particular of the nose wall at the axial height of the notch depth. The weakening section, in particular the predetermined buckling point or the notch, are designed and dimensioned in such a way that the bullet cannot break off or disintegrate in the region of the weakening section.

In an exemplary embodiment, a nose wall delimiting the cavity has on its inner side at least one edge oriented in the longitudinal direction of the bullet, in particular extending along the complete longitudinal extension of the cavity. The edge can be realized by a wall thickness decrease at which the wall thickness of the nose wall changes abruptly. It has been found that the deformation behavior of the bullets on impact with a target can also be adjusted via internal edges oriented in the longitudinal direction of the bullet.

According to an exemplary further development of the bullet, the nose wall comprises a plurality of edges arranged at a, in particular uniform, distance from one another in the circumferential direction. The edges may be of the same shape. For example, the edges result in a polygonal cross-sectional inner geometry of the cavity.

In another exemplary embodiment of bullets according to the invention, the metal or the iron bullet body is subjected to a heat treatment process, in particular an annealing step. For example, the temperature may be above 600° C., in particular 650° C., and/or the heat treatment process may be performed for a period of several hours, such as 4.5 hours. Through the heat treatment process, in particular heat after-treatment step, the deformation behavior of the bullet can be changed or adjusted. In particular, by means of the parameter's temperature or duration, the heat treatment process can influence the adjustment of the deformation behavior.

According to an alternative embodiment, the bullet is produced without a heat treatment process. In particular, the bullet, for example the bullet nose, is not annealed.

In another exemplary embodiment, the bullet is made of iron, in particular soft iron, for example steel. A carbon content may be, for example, more than 0.05% and/or at most 1.14% or 0.12%.

In another exemplary embodiment, the central cavity of the bullet is produced by solid forming, in particular by cold forming, such as deep drawing or extrusion. For example, the entire bullet is produced by means of solid forming, in particular by cold forming such as deep drawing or extrusion. The production of the bullet makes it possible, based on a metal wire or metal tube blank, to produce a bullet in a manufacturingly simple manner. Virtually no waste results.

According to a further exemplary further development, a filler component, in particular made of plastic, is inserted, in particular pressed, into the cavity. For example, the filler component can form the tip of the bullet in the assembled state. Alternatively, the filler component can be dimensioned and/or arranged in the cavity in such a way that, viewed in the longitudinal direction of the bullet, it does not protrude from the cavity. Further, the filler component may be sized and/or accommodated such that it projects axially from the cavity and first comes into contact with a target upon impact with the target. For example, the filler component may have a rotationally symmetric shape, such as a spherical, conical, or frustoconical shape. Further, the filler component may also have a plug-like shape.

According to a further aspect of the present invention, which can be combined with the preceding aspects and exemplary embodiments, a deformation bullet, in particular a hollow-point bullet, is provided, for example for police and/or authority ammunition, in particular with a caliber of at most 13 mm. The deformation bullet can be designed according to one of the previously described aspects or exemplary embodiments.

The deformation bullet comprises a bullet body with a jacket delimiting a central cavity, which is open to the surroundings. The bullet body can have a, in particular ogive-shaped, bullet nose, in which the cavity is arranged, and a bullet tail, which can be made substantially of solid material and/or can be fully cylindrical at least sectionally.

According to the further aspect of the invention, the deformation bullet, in particular the cavity, is produced by solid forming, in particular cold forming, in such a way that on impact of the deformation bullet on a target, the bullet nose jacket deforms in such way that it is widened by less than 90°, in particular less than 60°, in particular less than 450 or less than 30°, with respect to the longitudinal axis of the bullet. The target may be a standard target, which may be, for example, a jelly mass, in particular an unjacketed jelly mass. Furthermore, the launch of the deformed bullet at the target can be carried out under idealized test conditions in order to be able to inspect the deformed bullet impacted and collected in the jelly mass.

The wound ballistics or end ballistics of deformation bullets are largely determined by the so-called cross-sectional load, which results from the ratio of the mass of the bullet and its cross-sectional area. In general, the penetration depth of the bullet in the target increases with increasing cross-sectional load. This is basically due to the fact that the cross-sectional load in the end ballistics is determined by the increase in diameter of the bullet resulting from the expanding or mushrooming deformation, particularly in its front or nose region. To date, there is no deformation bullet in the state of the art, in particular one that is environmentally compatible, which, with a comparatively high cross-sectional load, meets the wound ballistic requirements with regard to a reduced penetration depth compared to non-expanding bullets. The conflict of interest between cross-sectional load or desired (mushrooming) deformation behavior and predetermined penetration depth cannot be satisfactorily resolved. In contrast to the strongly mushrooming and thereby very strongly expanding ogive jackets of prior art bullets, in which the ogive jacket expands and bends significantly more than 90° and in part up to 180° in relation to the longitudinal axis of the bullet and viewed in the direction of firing, during deformation after impact of the bullet on a target, the present invention detaches from this strong mushrooming deformation. The deformed bullet resembles a trumpet shape in the front region. The bullet according to the invention is characterized by a low penetration depth when the bullet impacts a target, despite the small diameter increase in the front region compared to the prior art. This effect is related in particular to texturing of the metal body as a result of the solid forming process, resulting in directional texturing, in particular in the ogive jacket, which guides the identified trumpet-shaped deformation. In particular, the texturing of the metal adjusts such that the strength is increased in the region of the ogive jacket transversely to the longitudinal direction of the bullet, in particular compared to the strength in the longitudinal direction. The increased strength transversely to the longitudinal direction is accompanied by less deformation radially outward upon impact of the bullet with a target, thereby attenuating mushrooming. Another reason for the reduced penetration depth is related to the front-side cavity of the bullet, which is open to the surroundings and in which air or air bubbles remain when the bullet penetrates the target, increasing the braking effect in the sense of the «cavitation bubble theory».

According to a further aspect of the present invention, there is provided a method for producing a deformation bullet according to the invention, in particular a hollow-point bullet, for example for police and/or authority ammunition, in particular with a caliber of at most 13 mm.

According to a further aspect of the present invention, which can be combined with the preceding aspects and exemplary embodiments, a tool, in particular a punch-die arrangement, is provided for producing a deformation bullet according to the invention, in particular a hollow-point bullet, for example for police and/or authority ammunition, in particular with a caliber of at most 13 mm.

Figure 2:
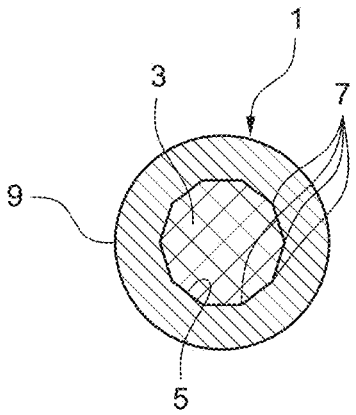
Figure 3:
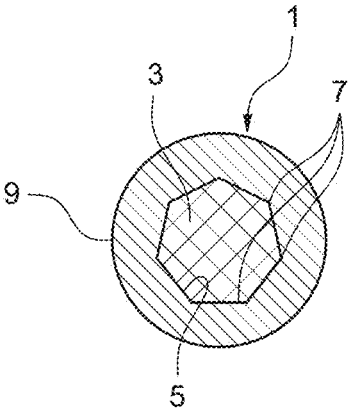
Figure 4:
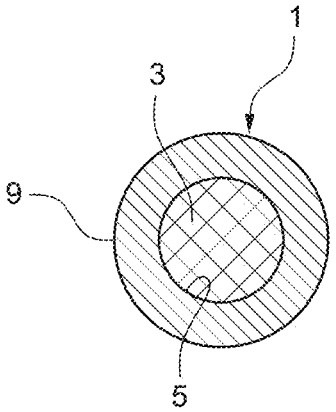
Figure 5:
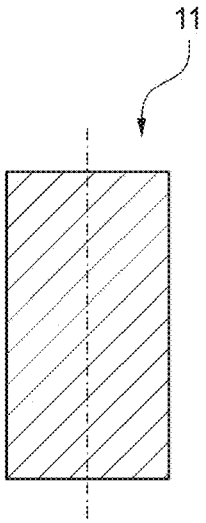
Figure 8:
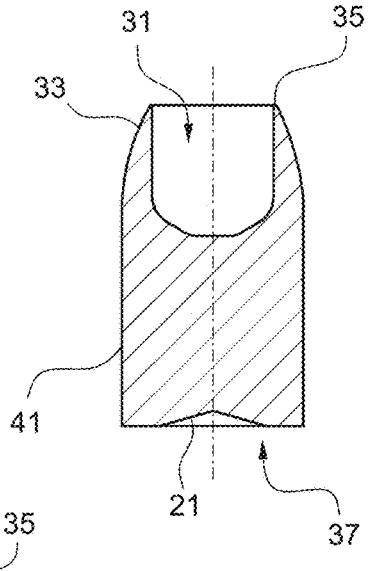
Figure 9:
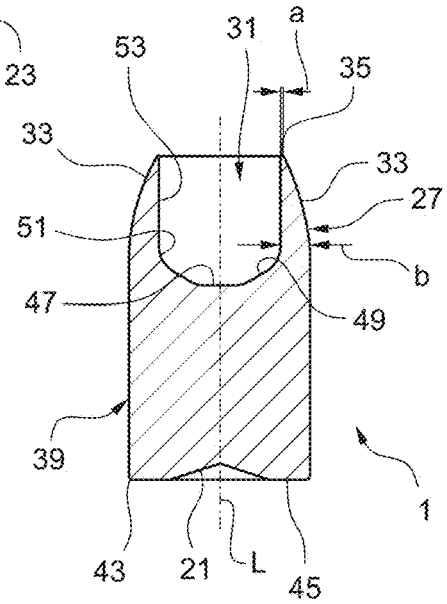
Figure 10:
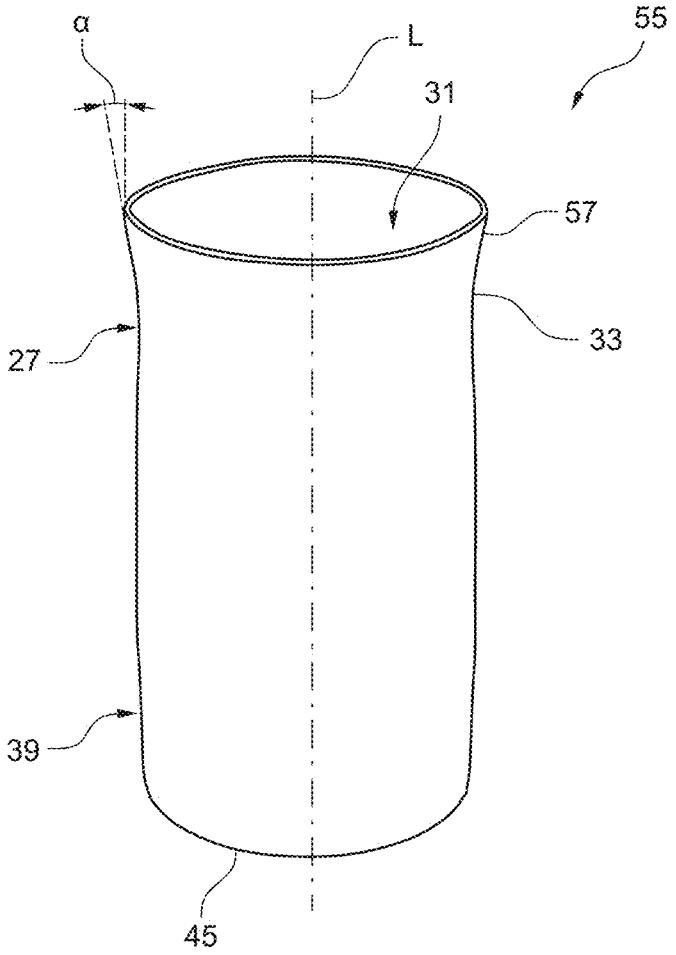

In the following, further properties, features and advantages of the invention will become clear by means of a description of preferred embodiments of the invention with reference to the accompanying exemplary drawings, in which show:

FIG. 1 a schematic view of a production step for producing a bullet according to the invention;

FIG. 2-4 schematic sectional views of FIG. 1;

FIG. 5-9 a schematic stage plan for the production of an exemplary embodiment of a bullet according to the invention starting from a blank; and FIG. 10 a schematic representation of a deformed projectile according to the invention.

The following description of exemplary embodiments of the present invention with reference to the accompanying figures illustrates advantages according to the invention with regard to the simple and cost-effective production of deformation bullets according to the invention. The deformation bullets illustrated in the figures are designed as hollow-point bullets and are used for police and/or government ammunition. The bullets are made of metal, preferably iron.

FIG. 1 schematically shows a production step, namely a solid forming step, in the production of bullets according to the invention, which are generally identified by the reference numeral 1. A combination of FIGS. 2 to 4 and 1 shows a particularly simple way of producing internal geometries of bullets of any cross-sectional shape. This is achieved in that the final cavity geometry or its cross-section can be generated by means of a stamping tool 3 which is pressed axially into an intermediate or blank forming the bullet 1, for forming a central, front-side cavity 5.

FIGS. 2 to 4 show associated schematic cross-sectional views showing the outer shape of the press plunger 3 and the inner cross-sectional shape of the cavity 5. The press plunger 3 and the cavity are point-symmetrical in cross-section, wherein a circular cross-sectional shape results according to FIG. 4, and polygonal cross-sectional shapes in FIGS. 2 and 3. Due to the axial press formation by means of the press plunger 3, the cavity cross section 5 is substantially constant when viewed in the longitudinal direction of the bullet. Thus, the polygonal cavity inner geometry results in axial edges 7 formed along the complete longitudinal extension of the cavity 5 on an inner side of a nose wall 9 surrounding the cavity 5. A general advantage of the present invention is that the bullet geometry can be adapted very flexibly during solid forming. In particular, any internal geometry can be easily produced by simply adapting the outer shape or contour of the elongated substantially cylindrical.

With reference to FIGS. 5 to 9, which show a stage plan for the production of a bullet 1 according to the invention, the individual production steps become apparent. First, a blank 11 of metal, preferably iron, is provided (FIG. 5), which is obtained from continuous raw material, such as a wire or tube, by cutting. The blank 11 is made of a particularly homogeneous material and is constructed in one piece, in particular from solid material.

Figure 6:
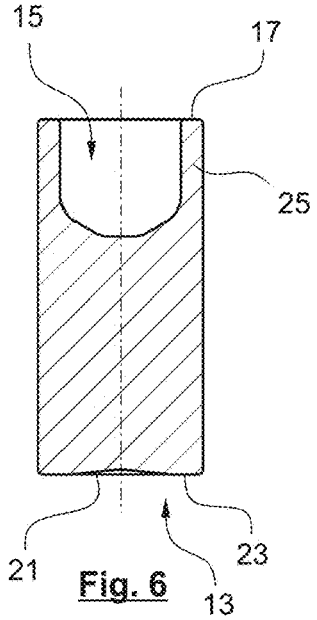

In a first production step, the blank 11 is cold-formed into a set workpiece 13 by setting, for example by pressing (FIG. 6). As can be seen from a comparison of FIGS. 5 and 6, setting is accompanied by an expansion in length of the intermediate product, wherein the outer diameter remains substantially constant. The increase in length results from the central recess 15 introduced at an end face 17 of the set workpiece 13 during setting, which causes a displacement of material that manifests itself in an expansion in length. Opposite the recess 15, that is, on the opposite face side 23, is a centering recess 21. Setting can be performed via a punch-die arrangement (not shown), wherein the punch outer geometry determines the recess inner geometry 15. A jacket wall 25 surrounding the recess 15 is further deformed in subsequent steps to form the subsequent bullet nose 27.

Figure 7:
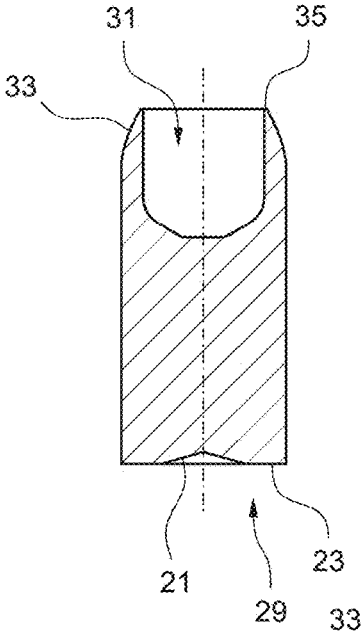

After setting, the set workpiece 13 is prepressed to form a preform 29 (FIG. 7). The preform 13 is deformed in the region of the jacket wall 25 for forming the preform 29, so that the final cavity geometry of the front cavity 31 of the bullet 1 is already obtained. The ring-cylindrical jacket wall 25 is deformed into a nose wall 33 which tapers at least sectionally in the shape of an ogive. As a result of the nose wall 33 tapering towards the bullet tip 35, i.e. decreasing in wall thickness, the longitudinal dimension of the bullet or the longitudinal dimension of the section forming the later bullet nose 27 is extended relative to the jacket wall 25.

The preform 29 is then further cold-formed for forming a cylindrical blank 37 shown in FIG. 8, which for the most part already has the complete geometry of the final bullet 1. The cylindrical blank 37 is compressed in the axial direction starting from the preform 29, wherein the cavity interior geometry 31 is maintained. Due to the axial compression of the preform 29, the diameter at the cylindrical blank 37 increases. The cylindrical blank 37 has a fully cylindrical section 41 comprising substantially of solid material and located in the area of the later bullet tail 39, which is formed over a large part of the longitudinal extension of the cylindrical blank up to the ogive-like tapering of the nose jacket 33. For the production of the final bullet 1, the bullet nose 27 remains substantially unchanged. The bullet tail 39 may be further machined by cold forming steps.

For example, a chamfer 43, which is circumferential, can be introduced at the tail-side (FIG. 9). The final bullet 1 has a substantially planar bullet bottom 45 at the tail-side, in the center of which the centering recess 21 is located. Furthermore, it is possible that the bullet tail is for the most part no longer fully cylindrical, but deviates for the most part from a cylindrical shape and is cylindrical only in regions, in particular in a region defining the guide band, which defines the caliber. In other respects, for example, the outer diameter of the bullet tail can be slightly reduced starting from the guide band in the direction of the bullet bottom 45.

The cavity 31 may, for example, have a planar cavity base 47 as viewed at least in sections transversely to the longitudinal extension of the bullet 1, which may also be concave in shape. The concave or planar cavity base region 47 leads into an outer cavity base region 49 of greater curvature or inclination relative to the longitudinal axis of the bullet compared to the cavity base region 47. The outer cavity base section 49 merges at a transition 51 into a cavity side wall 53, which is oriented substantially parallel to the longitudinal axis L of the bullet. The cavity sidewall 53 thus delimits a substantially hollow cylindrical front-side cavity section, which may have a longitudinal extension in the range of 10% to 50% of the longitudinal dimension of the bullet. The constant inner diameter cavity sidewall 53 may be present over at least 30%, at least 40%, at least 50%, at least 60%, at least 70%, at least 80%, or at least 90% of a total longitudinal extension of the cavity 31.

For example, in the region of the front-side opening 35, the nose wall 33 may have a wall thickness in the range of 10%-50% of the wall thickness in the nose wall 33 at the axial height of the cavity base in the region of the transition 51 between cavity and side wall 53 and outer cavity base section 49. The wall thickness a in FIG. 9 indicates the wall thickness in the region of the front-side opening 35 and the reference sign b indicates the wall thickness in the region of the transition 51 of the nose wall 33.

A schematic representation of a projectile 1 deformed according to the invention is shown in FIG. 10 and is generally designated by the reference numeral 55. The deformed projectile 55 differs from prior art projectile in particular by a reduced mushrooming effect upon impact with a target. As can be seen in FIG. 10, the front deformed section 57 of the nose wall 33 forming the ogive jacket is expanded or mushroomed by significantly less than 90° with respect to the longitudinal axis L of the bullet, resulting in a trumpet-shaped configuration in the front-side region. The trumpet-shaped deformation section 57 of the ogive jacket 33 has substantially the same cross-section and the same deformation in the circumferential direction.

The features disclosed in the foregoing description, figures, and claims may be significant both individually and in any combination for the realization of the invention in the various embodiments.

REFERENCE LIST

1 Bullet
3 Press plunger
5 Cavity
7 Axial edge
9 Nose wall
11 Blank
13 Set workpiece
15 Recess
17 Face side
21 Centering recess

23 Face side
25 Jacket wall
27 Bullet nose
29 Preform
31 Cavity
33 Nose wall
35 Bullet tip
37 Cylindrical blank
39 Bullet tail
41 Cylindrical section
43 Chamfer
45 Bullet bottom
47 Cavity base
49 Outer cavity base section
51 Transition
53 Cavity side wall
55 Deformed projectile
57 Deformed section of the nose wall
a Wall thickness
α Deformation angle
L Longitudinal axis of the bullet

The invention claimed is:

1. A hollow-point bullet with a caliber of at most 13 mm, the bullet comprising a bullet tail, and a bullet nose with a central cavity having a front-side opening, wherein a diameter of the front-side opening of the cavity is greater than 50% of the caliber of the bullet, and wherein the bullet is made in one piece of an iron-based material, wherein the bullet nose is ogive shaped, wherein a nose wall delimiting the cavity has a substantially constant inner diameter, wherein a length of the cavity dimensioned in the longitudinal direction of the bullet is at most 50% of the bullet length, and wherein the cavity is not occupied by a filler component.

2. The hollow-point bullet according to claim 1, wherein the bullet is made of steel with a carbon content of more than 0.05% and of at most 1.14%.

3. The hollow-point bullet according to claim 1, wherein the bullet is made of an iron-based material comprising, in addition to iron, at least one further transition metal selected from the group consisting of manganese and copper at a mass fraction from 0.01% to 1.2%.

4. The hollow-point bullet according to claim 1, wherein the iron-based material comprises at least one additive selected from the carbon group, the nitrogen group and/or the oxygen group, and has a weight percentage of at least 0.01% to at most 0.48%.

5. The hollow-point bullet according to claim 1, wherein the iron-based material has a manganese content from 0.01% to 0.8%.

6. The hollow-point bullet according to claim 1, wherein the iron-based material has a silicon content of less than 0.5%.

7. The hollow-point bullet according to claim 1, wherein the iron-based material has a phosphorus content in the range from 0.01% to 0.04%.

8. The hollow-point bullet according to claim 1, wherein the iron-based material has a sulfur content in the range from 0.01% to 0.04%.

9. The hollow-point bullet according to claim 1, wherein the iron-based material has a copper content of less than 0.4%.

10. The hollow-point bullet according to claim 1, wherein the cavity extends from a front-side opening without forming an undercut in the direction of a tail-side cavity base, wherein the bullet is made in one piece, and wherein the cavity is not occupied by a filler component.

11. The hollow-point bullet according to claim 10, wherein the diameter of the front-side opening of the cavity is at least 65% of the caliber of the bullet.

12. The hollow-point bullet according to claim 1, wherein the cavity length is at most 40% of the bullet length.

13. The hollow-point bullet according to claim 1, wherein a wall thickness of a nose wall delimiting the cavity at the bullet tip is in the range from 0.1 to 2 mm.

14. The hollow-point bullet according to claim 1, wherein the bullet tip is formed by a circumferential ring, whose wall thickness is less than 1 mm.

15. The hollow-point bullet according to claim 1, wherein an outer diameter of a nose wall delimiting the cavity circumferentially increases starting from the bullet tip in the direction of the bullet tail.

16. The hollow-point bullet according to claim 1, wherein the central cavity has a cross-section which is point-symmetrical and deviates from a circular shape and is substantially constant in the longitudinal direction of the bullet.

17. The hollow-point bullet according to claim 1, wherein a nose wall delimiting the cavity has on its outer side at least one weakening section oriented in the circumferential direction.

18. The hollow-point bullet according to claim 17, wherein the weakening section forms a predetermined buckling point such that when the bullet impacts a target, the nose wall buckles radially outward at the predetermined buckling point.

19. The hollow-point bullet according to claim 17, wherein the weakening section is realized as a notch.

20. The hollow-point bullet according to claim 1, wherein a nose wall delimiting the cavity has on its inner side at least one edge oriented in the longitudinal direction of the bullet.

21. The hollow-point bullet according to claim 20, wherein the nose wall has a plurality of edges arranged at a distance from one another in the circumferential direction.

22. The hollow-point bullet according to claim 1, wherein the iron-based material of the bullet body has been subjected to a heat treatment process.

23. The hollow-point bullet according to claim 1, which is produced without a heat treatment process.

24. The hollow-point bullet according to claim 3, wherein the iron-based material has a carbon content of more than 0.05% and at most 1.14%.

25. The hollow-point bullet according to claim 1, wherein the central cavity is produced by cold forming.

26. The hollow-point bullet according to claim 1, wherein a nose wall delimiting the cavity at the bullet tip has the property that, on impact of the bullet on a target, the nose wall delimiting the cavity at the bullet tip deforms in such a way that it is widened by less than 90° with respect to the longitudinal axis of the bullet.

* * * * *